US010651535B2

(12) United States Patent
Niwano et al.

(10) Patent No.: US 10,651,535 B2
(45) Date of Patent: May 12, 2020

(54) ANTENNA DEVICE

(71) Applicant: AGC INC., Tokyo (JP)

(72) Inventors: Kazuhiko Niwano, Tokyo (JP); Koji Ikawa, Tokyo (JP)

(73) Assignee: AGC INC., Tokyo (JP)

( * ) Notice: Subject to any disclaimer, the term of this patent is extended or adjusted under 35 U.S.C. 154(b) by 129 days.

(21) Appl. No.: 15/458,629

(22) Filed: Mar. 14, 2017

(65) Prior Publication Data

US 2017/0187090 A1 Jun. 29, 2017

Related U.S. Application Data

(63) Continuation of application No. PCT/JP2015/077971, filed on Oct. 1, 2015.

(30) Foreign Application Priority Data

Oct. 3, 2014 (JP) ..... 2014-204635

(51) Int. Cl.

| | |
|---|---|
| ***H01Q 1/32*** | (2006.01) |
| ***H01Q 1/12*** | (2006.01) |
| ***H01Q 9/42*** | (2006.01) |
| ***H01Q 9/26*** | (2006.01) |
| ***H01Q 1/48*** | (2006.01) |

(52) U.S. Cl.

CPC ..... *H01Q 1/1271* (2013.01); *H01Q 1/48* (2013.01); *H01Q 9/26* (2013.01); *H01Q 9/42* (2013.01)

(58) Field of Classification Search

None

See application file for complete search history.

(56) References Cited

U.S. PATENT DOCUMENTS

| | | | | |
|---|---|---|---|---|
| 4,253,099 | A * | 2/1981 | Yamazaki | H01Q 9/12 343/713 |
| 6,057,803 | A * | 5/2000 | Kane | H01Q 1/32 343/713 |
| 6,437,750 | B1 * | 8/2002 | Grimes | H01Q 7/00 343/726 |
| 6,836,250 | B2 * | 12/2004 | Dai | H01Q 1/38 343/700 MS |
| 6,853,339 | B2 * | 2/2005 | Sievenpiper | H01Q 1/3275 343/712 |
| 7,742,004 | B2 * | 6/2010 | Fukushima | H01Q 19/30 343/702 |
| 2004/0012534 | A1 | 1/2004 | Dai et al. | |

(Continued)

FOREIGN PATENT DOCUMENTS

| | | |
|---|---|---|
| DE | 10 2004 051 725 A1 | 4/2006 |
| EP | 0 797-268 A2 | 9/1997 |

(Continued)

OTHER PUBLICATIONS

International Search Report issued in International Patent Application No. PCT/JP2015/077971 dated Dec. 22, 2015.

*Primary Examiner* — Trinh V Dinh

(74) *Attorney, Agent, or Firm* — Foley & Lardner LLP

(57) ABSTRACT

An antenna device is to be installed in a vehicle. The antenna device includes a first element; a second element; and a feeding part. An angle formed between an electric field plane generated at the first element and the second element and a direction of a long side of the vehicle is within a range of ±45 degrees.

17 Claims, 9 Drawing Sheets

(56) References Cited

U.S. PATENT DOCUMENTS

| | | | | |
|---|---|---|---|---|
| 2004/0017316 | A1 | 1/2004 | Tanaka et al. | |
| 2005/0174291 | A1 | 8/2005 | Inatsugu et al. | |
| 2005/0275598 | A1 | 12/2005 | Ohara | |
| 2006/0097935 | A1 | 5/2006 | Colburn et al. | |
| 2008/0246672 | A1 | 10/2008 | Sliskovic et al. | |
| 2008/0291097 | A1* | 11/2008 | Fukushima | H01Q 1/1271 343/713 |
| 2010/0302113 | A1 | 12/2010 | Sugimoto et al. | |
| 2015/0061964 | A1* | 3/2015 | Sugimoto | H01Q 9/42 343/893 |
| 2015/0120189 | A1* | 4/2015 | Giometti | H01Q 5/22 701/522 |
| 2015/0270614 | A1* | 9/2015 | Kakuya | H01Q 5/328 343/818 |
| 2016/0226127 | A1* | 8/2016 | Niwano | H01Q 1/1271 |
| 2016/0336642 | A1* | 11/2016 | Makimura | H01Q 1/24 |

FOREIGN PATENT DOCUMENTS

| | | | |
|---|---|---|---|
| EP | 1 338 058 | A | 5/2002 |
| GB | 2 028 592 | A | 3/1980 |
| JP | H09-083242 | A | 3/1997 |
| JP | 2001-044730 | A | 2/2001 |
| JP | 2004-134881 | A | 4/2004 |
| JP | 2006-086885 | A | 3/2006 |
| JP | 2006-262355 | A | 9/2006 |
| JP | 2007-068106 | A | 3/2007 |
| JP | 2009-188912 | A | 8/2009 |
| WO | WO-00/54366 | | 9/2000 |

* cited by examiner

ANTENNA DEVICE

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2015/077971 filed on Oct. 1, 2015 and designating the U.S., which claims priority of Japanese Patent Application No. 2014-204635 filed on Oct. 3, 2014. The entire contents of the foregoing applications are incorporated herein by reference.

BACKGROUND OF THE INVENTION

1. Field of the Invention

The present disclosure relates to an antenna device to be installed inside a room of a vehicle, and a vehicle antenna in which the antenna device is installed.

2. Description of the Related Art

Usually, an antenna for receiving a radio broadcast or an antenna for receiving a television broadcast is installed in a vehicle. Recently, however, a demand has been growing for installing an antenna for transmitting and receiving vertically polarized radio waves, which have been used for inter-vehicle communication and road-to-vehicle communication in the ITS (Intelligent Transport System: Intelligent Transportation System).

As the antennas for transmitting and receiving the vertically polarized radio waves, there are disclosed a vehicle antenna (Patent Document 1 (Japanese Unexamined Patent Publication No. 2001-44730)) provided with an antenna pattern that is installed to be parallel to a surface of a window glass at a position at an upper part of the interior side of the window glass of the vehicle, to which a rear-view mirror pedestal is to be bonded; and an antenna (Patent Document 2 (Japanese Unexamined Patent Publication No. 2009-188912)) formed of a first radiation conductor and a second radiation conductor, where the first radiation conductor is formed on a vehicle interior side surface of the window glass of the vehicle, and the second radiating conductor is bent toward inside the vehicle so as to form a predetermined angle.

For a case of the vehicle antenna disclosed in Patent Document 1, which is related art, however, there is a problem that, since the antenna pattern is formed that is parallel to the glass surface of the vehicle, transmission and reception sensitivity with respect to vertically polarized waves arriving in a direction horizontal to the ground is affected by an installation angle of the window glass of the vehicle.

For a case of the vehicle antenna disclosed in Patent Document 2, there is also a problem that, since the first radiation conductor is formed on the window glass surface of the vehicle, transmission and reception sensitivity with respect to vertically polarized waves arriving in the direction horizontal to the ground is affected by an installation angle of the window glass of the vehicle.

There is a need for an antenna device that can enhance transmission and reception characteristics with respect to vertically polarized waves arriving in the direction horizontal to the ground, without depending on an installation angle of an window glass of a vehicle.

SUMMARY OF THE INVENTION

According to an aspect of the present invention, there is provided an antenna device to be installed in a vehicle, wherein the antenna device includes a first element; a second element; and a feeding part, and wherein an angle formed between an electric field plane generated at the first element and the second element and a direction of a long side of the vehicle (a direction of a longitudinal axis of the vehicle) is within a range of ±45 degrees.

According to another aspect of the present invention, there is provided a vehicle antenna including an antenna device, wherein the antenna device includes a first element; a second element; and a feeding part, and wherein an angle formed between an electric field plane generated at the first element and the second element and a direction of a long side of the vehicle is within a range of ±45 degrees.

According to the present invention, since it does not depend on an installation angle of the window glass of the vehicle, and an antenna conductor is not to be bent toward inside the vehicle, transmission and reception characteristic with respect to vertically polarized waves arriving in a direction horizontal to the ground can be enhanced, compared to an antenna device according to related art.

DESCRIPTION OF THE PREFERRED EMBODIMENTS

Figure 1:
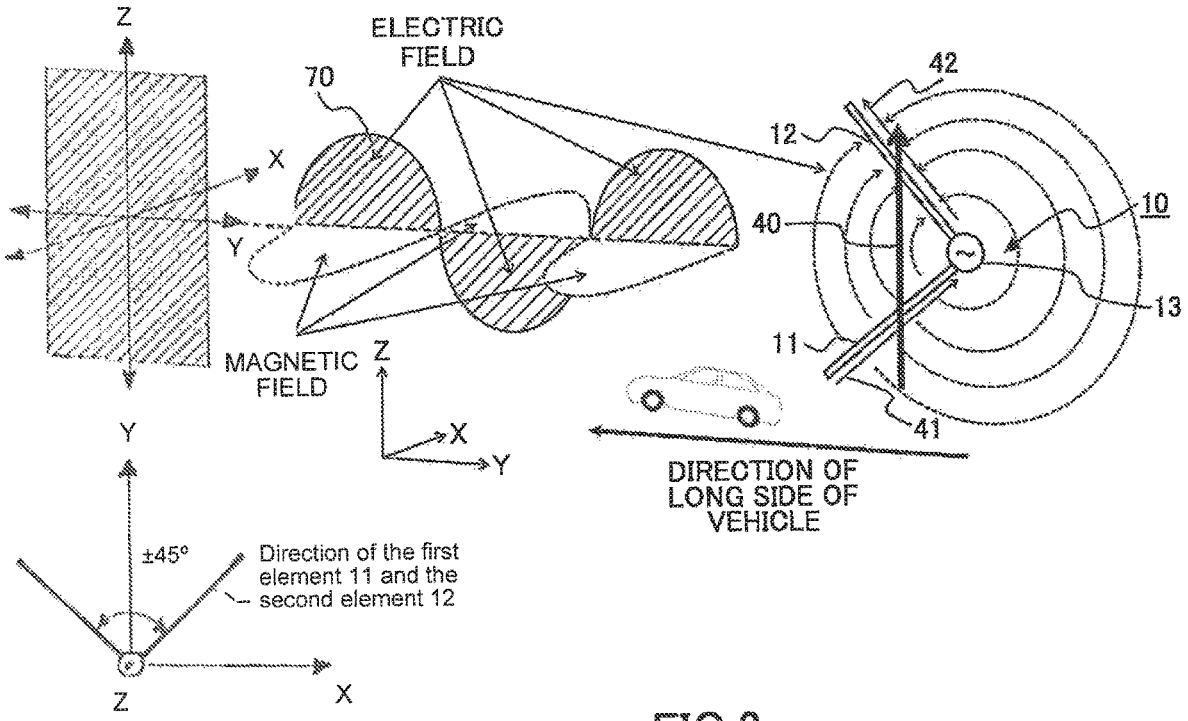
FIG. 1 is a schematic diagram illustrating an antenna device according to a first embodiment of the present invention and a general electric field plane of a vertically polarized wave.

An embodiment is described below by referring to the drawings. In the drawings for describing the embodiments, when a direction is not particularly described, the direction refers to the direction on the drawing, and the orientation of each drawing corresponds to the direction of the symbols and the numbers.

First Embodiment

FIG. 1 is a perspective view of an antenna device 10 according to a first embodiment of the present invention. The antenna device 10 is to be installed in a vehicle; and includes a first element 11, a second element 12, and a feeding part 13. Upon a high frequency electric current being supplied to the first element 11 and the second element 12 from the feeding part 13, the electric current flows through the first element 11 and the second element 12. Then, a magnetic field is generated in the vicinity of the first element 11 and the second element 12, and an electric field plane is generated on a surface perpendicular to the magnetic field plane.

As illustrated in FIG. 1, the electric field plane generated at the antenna device 10 is formed to be parallel to the YZ plane in FIG. 1. At this time, if an angle formed between the YZ plane in FIG. 1 and a long side (the Y axis direction) of a vehicle is within a range of ±45 degrees, an angle between the electric field plane generated by the antenna device 10 and an electric field plane of a vertically polarized wave 70 arriving at the vehicle in a direction horizontal to the ground (the Y axis direction) is within a range of ±45 degrees, so that transmission and reception characteristics with respect to the vertically polarized wave 70 arriving in the direction horizontal to the ground (the Y axis direction) are enhanced. Preferably, the angle is within a range of ±30 degrees; and, more preferably, the angle is within a range of ±20 degrees.

Figure 2:
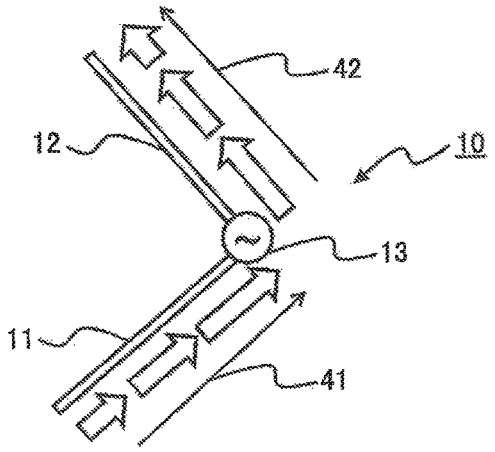
FIG. 2 is a schematic diagram illustrating an electric current vector of the antenna device according to the first embodiment of the present invention.

By using FIG. 2, operation of the antenna device 10 according to the first embodiment of the present invention is described. In the antenna device 10 according to the first embodiment, in each of the first element 11 and the second element 12, one end is an open end; and the first element 11 and the second element 12 are electrically coupled to the feeding part 13 at the respective ends that are different from the open ends.

The feeding part 13 is a part for coupling the antenna device 10 to a signal processing circuit, which is not depicted. In FIG. 2, the feeding part 13 is located at a part where the first element 11 and the second element 12 intersect; however, it is not limited to this, as long as the antenna device 10 can operate as a dipole antenna with such a part.

As illustrated in FIG. 2, upon a high frequency electric current being fed by the feeding part 13 to the antenna device 10 according to the first embodiment, an electric current is generated from the open end of the first element 11 to the open end of the second element 12. At this time, an electric current distribution becomes stronger from the edge end of the first element 11 toward the feeding part 13; and the electric current distribution becomes weaker from the feeding part 13 toward the edge of the second element 12. Ideally, the electric current approaches zero without limit at the edges of the first element and the second element.

In the first element 11, a first electric current vector 41 is generated that is determined by the electric current distribution flowing from the edge of the first element 11 to the feeding part 13, and an extending direction from the edge of the first element 11 to the feeding part 13. Furthermore, in the second element 12, a second electric current vector 42 is generated that is determined by the electric current distribution flowing from the feeding part 13 to the edge of the second element 12, and an extending direction from the feeding part 13 to the edge of the second element 12.

Figure 3:
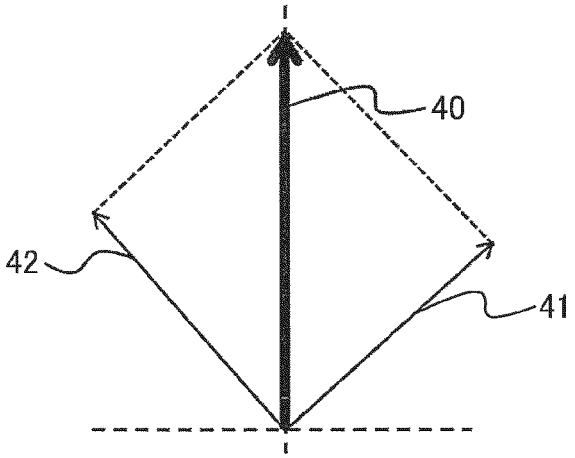
FIG. 3 is a schematic diagram illustrating a combined electric current vector of the antenna device according to the first embodiment of the present invention.

At this time, as illustrated in FIG. 3, if a direction of a combined electric current vector 40 obtained by combining the first electric current vector 41 and the second electric current vector 42 is an angle within a range of 90 degrees±45 degrees with respect to the ground, the transmission and reception characteristics with respect to vertically polarized waves arriving in a direction horizontal to the ground are enhanced. Preferably, the angle is within a range from 90 degrees±30 degrees; and more preferably within a range from 90 degrees±20 degrees.

Since an antenna operates in an alternating-current manner, a generated electric current also flows in the reverse direction, namely, from the open end of the second element 12 to the open end of the first element 11. Consequently, the directions of the first electric current vector 41, the second electric current vector 42, and the combined electric current vector 40 vary in the alternating-current manner.

Here, a case is described where an electric current is generated from the open end of the first element 11 to the open end of the second element 12; however, as described above, since the situation is the same for the case where the direction in which the electric current flows is reversed, the angle formed by the combined electric current vector 40 with respect to the ground includes, not only the angle formed upward with respect to the ground, but also the angle formed downward. Furthermore, the combined electric current vector 40 is determined by an electric current vector at a moment at which the strength of the first electric current vector 41 and the second electric current vector 42, which vary in an alternating-current manner, becomes the strongest, namely, at a moment at which the electric current flows through one end to the other end.

Figure 4:
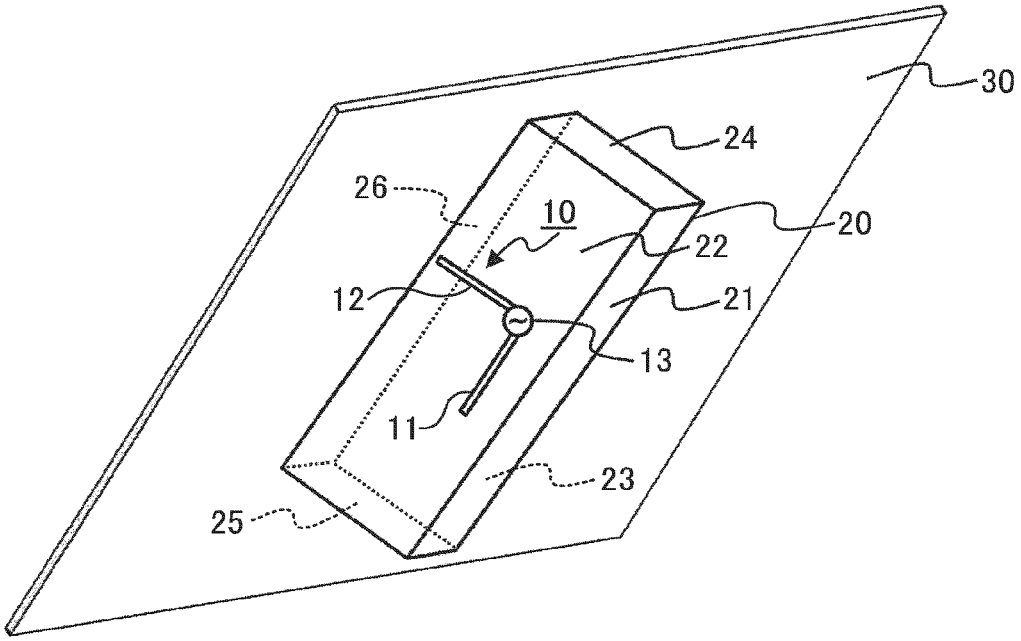
FIG. 4 is a perspective view of a support member in which the antenna device according to the first embodiment of the present invention is included.

As illustrated in FIG. 4, the antenna device 10 may be formed at a side surface part 22 of a support member 20, which is provided with the side surface part 22 that is approximately parallel to the long side direction of the vehicle. Furthermore, in FIG. 4, a case is exemplified where the antenna device 10 is formed at the side surface part 22; however, it may be formed at a side surface part 23.

The support member 20 is preferably formed of an insulating material, such as a resin; however, it is not limited to this, as long as the antenna device 10 is formed and functions as the antenna.

The support member 20 may be provided with the side surface part 23 that is formed to face the side surface part 22; and may be provided with a front surface part 21 that is approximately parallel to the surface to which the support member is to be attached.

It suffices if the shape of the support member 20 is such that, when it is viewed from the front of the support member 20, it has side surfaces such that the antenna device 10 can be installed in one of the side surfaces in the left-right direction, such as a rectangular parallelepiped; however, it is not limited to this, as long as it can be installed in the vehicle without difficulty.

The support member 20 including the antenna device 10 may be installed above the window glass 30 of the vehicle; for example, in the vicinity of an inner surface of the window glass 30 of the vehicle, such as a front glass or a rear glass.

Here, the "vicinity of the inner surface of the window glass 30 of the vehicle" specifies a range that does not depart from the effect of the present invention; specifically, it refers to interior material inside the room of the vehicle that is usually within 1 m from the surface of the window glass 30 and a fringe of the window glass 30. Furthermore, for a case where the support member 20 including the antenna device 10 is formed on the inner surface of the window glass 30, the antenna device 10 may be in contact with the window glass 30, or may not be in contact with it.

The support member 20 including the antenna device 10 may preferably be located on the inner surface of the window glass 30 and at the fringe of the window glass 30, so that reception characteristics and transmission characteristics can be enhanced with respect to vertically polarized waves arriving in the direction horizontal to the ground. Furthermore, it is preferable because the antenna device is not formed to spread on the surface of the window glass 30, and the appearance and a visual field of a passenger are not damaged.

For a case where the support member 20 including the antenna device 10 is formed within an inner surface of a windshield of the vehicle, various types of in-vehicle sensors, such as a rain sensor, in-vehicle cameras, and so forth may be arranged inside the support member 20 or in the vicinity of the support member 20. Furthermore, the support member 20 may be provided inside a bracket for storing various types of in-vehicle sensors, in-vehicle cameras, and so forth. Furthermore, the support member 20 may be an attachment base of a rear-view mirror.

The support member 20 may include a plurality of antenna devices 10. Furthermore, the antenna devices 10 may be formed not only at the side surface part 22, but also at the side surface part 23. Furthermore, a plurality of support members 20 respectively including the antenna devices 10 may be formed in the vehicle.

For a case where the antenna devices 10 are separated from each other and are arranged in the vehicle width direction, it can operate as a diversity antenna exhibiting favorable transmission and reception characteristics with respect to vertically polarized waves arriving from any of the right and left directions relative to the traveling direction of the vehicle. Furthermore, by providing the plurality of antenna devices 10, it may be operated as a MIMO (Multiple Input-Multiple Output) antenna.

In the antenna device 10 illustrated in FIG. 4, the first element 11 is a linear or belt-shaped conductor whose one end is an open end. Furthermore, the second element 12 is a linear or belt-shaped conductor whose one end is an open end. Further, the first element 11 and the second element 12 are electrically coupled to the feeding part 13 at the other ends, which are different from the open ends. Here, "electrically coupled to" includes that the conductors directly contact each other so as to conduct in a direct current manner; and that the conductors are separated from each other by a predetermined distance to form a capacitor so as to conduct in a high frequency manner.

Figure 5:
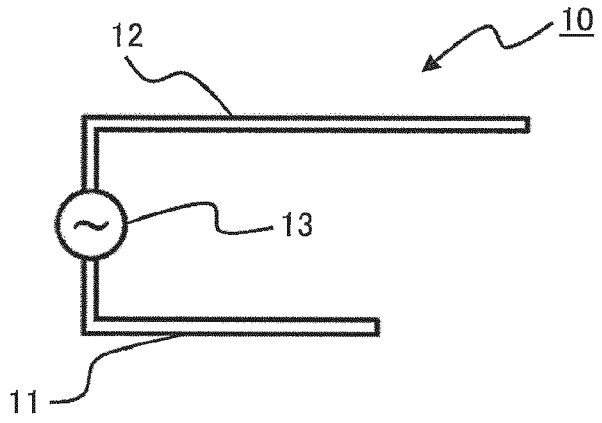
FIG. 5 is a plan view of the antenna device according to another embodiment.

In FIG. 4, a case is exemplified where the first element 11 and the second element 12 are linear; however, the first element 11 and the second element 12 may have bent shapes, such as meandering shapes, or may have branching points. Furthermore, as illustrated in FIG. 5, the second element 12 may have a shape, such as a U-shape, that is folded back to the open end side of the first element 11.

Figure 6:
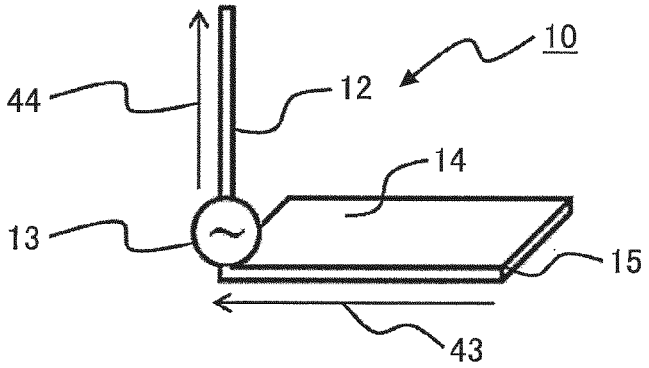
FIG. 6 is a plan view of the antenna device according to another embodiment.

As illustrated in FIG. 6, at least a part of a first element 14 may be a wide conductor. At this time, at least a part of the first element, which is the wide conductor, may preferably be formed on a surface adjacent to the side surface part. The first element that is a wide conductor may be formed on the front surface part 21 of the support member 20; may be an attachment part 26 facing the front surface part; may be a top part 24; or may be a bottom part 25.

When the first element 14 is the wide conductor, at least a part of an edge side of the wide conductor is preferably formed along an edge side of the side surface part 22 on which the second element 12 is formed. Furthermore, when at least a part of the first element 14 is the wide conductor and is formed along the edge side of the side surface part 22 on which the second element 12 is formed, and when the first element 14 is a ground conductor, power can be fed to the antenna device 10 with a more simple configuration.

As illustrated in FIG. 6, when at least a part of the first element 14 is the wide conductor, and when at least a part of the edge side of the wide conductor is formed along the edge side of the side surface part 22, on which the second element 12 is formed, as an electric current generated in the antenna device 10, an electric current is generated from the vicinity of an end portion 15 of the edge side of the side surface part 22 of the first element 14 to the open end of the second element 12.

Accordingly, as illustrated in FIG. 6, when at least a part of the first element 14 is the wide conductor, and when at least a part of the edge side of the wide conductor is formed along the edge side of the side surface part 22, on which the second element 12 is formed, a combined electric current vector generated in the antenna device 10 is determined by a combine electric current vector of the first electric current vector 43 that is determined by: an electric current distribution that flows from the end portion 15 of the first element 14 to the feeding part 13 and the extending direction from the end portion 15 of the first element 14 to the feeding part 13; and the second electric current vector 44 that is determined by an electric current distribution that flows from the feeding part 13 to the edge of the second element 12 and the extending direction from the feeding part 13 to the edge of the second element 12.

For a case where the antenna device 10 is installed in the support member 20, if the direction of the combined electric current vector 40 generated in the antenna device 10 is an angle within a range from 90 degrees±45 degrees with respect to the ground, transmission and reception characteristics for the vertically polarized waves arriving in the direction horizontal to the ground are enhanced, so that the transmission and reception characteristics for the vertically polarized waves arriving in the direction horizontal to the ground can be enhanced, regardless of shifts in the position and the angle for attaching the antenna device 10, and positional robustness can be enhanced. Note that the high positional robustness implies that, even if the arranged positions and so forth of the first element 11 and the second element 12 are shifted, a small effect is caused on the operation and the directivity of the antenna device 10. Furthermore, since the degree of freedom on determining the arranged positions of the first element 11 and the second element 12 is high, it is advantageous in a point that the installation position, the attachment angle of the antenna device 10, and so forth can be freely designed.

When at least a part of the first element 14 is the wide conductor, wide-band characteristics of the antenna device 10 can be achieved.

Figure 12:
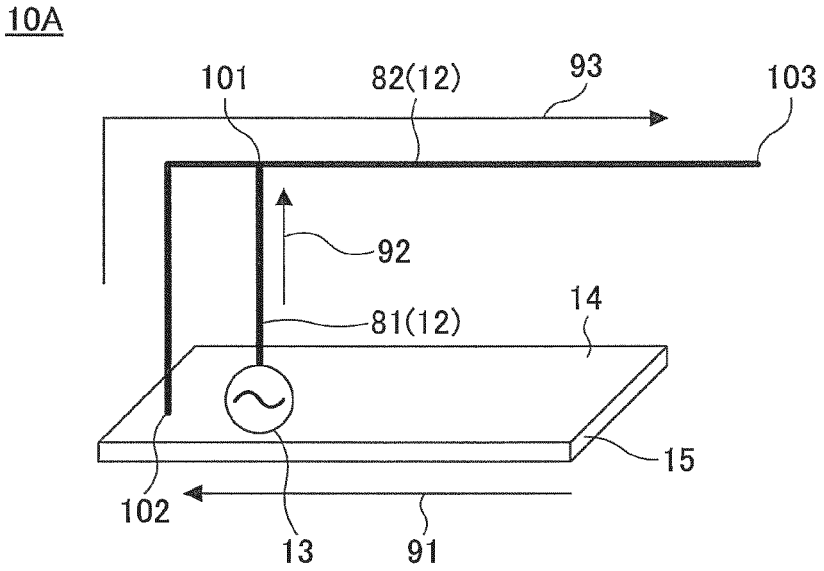
FIG. 12 is a configuration diagram illustrating a modified example of the antenna device according to the first embodiment.

FIG. 12 is a diagram illustrating an example of a configuration of an antenna device 10A for a case where the first element 14, at least a part of which is the wide conductor, is used as the ground conductor. Since the antenna device 10A includes the first element 14, at least the part of which is the wide conductor, the wide-band characteristics of the antenna device 10A can be achieved. At least a part of the edge side of the first element 14, at least the part of which is the wide conductor, is formed along the edge side of the side surface part 22, on which the second element 12 is formed.

The antenna device 10A includes the second element 12 having an inverted F shape. The inverted F shaped second element 12 includes a feed element 81; and a radiating element 82 connected to the feed element 81 at a connecting point 101. The feed element 81 contacts the radiating element 82 to feed power. The feed element 81 is, for example, a linear element including one end coupled to the feeding part 13; and the other end connected to the radiating element 82 at the connecting point 101. The radiating element 82 is, for example, an L-shaped element including one edge 102 connected to the first element 14 to be used as the ground conductor; and the other edge 103 that is at the opposite side of the one edge 102.

The combined electric current vector generated in the antenna device 10A is determined by a first electric current 91 from the end portion 15 of the first element 14 toward the edge 102; a second electric current 92 from the feeding part 13 toward the connecting point 101; and a third electric current 93 from the edge 102 toward the edge 103.

Figure 13:
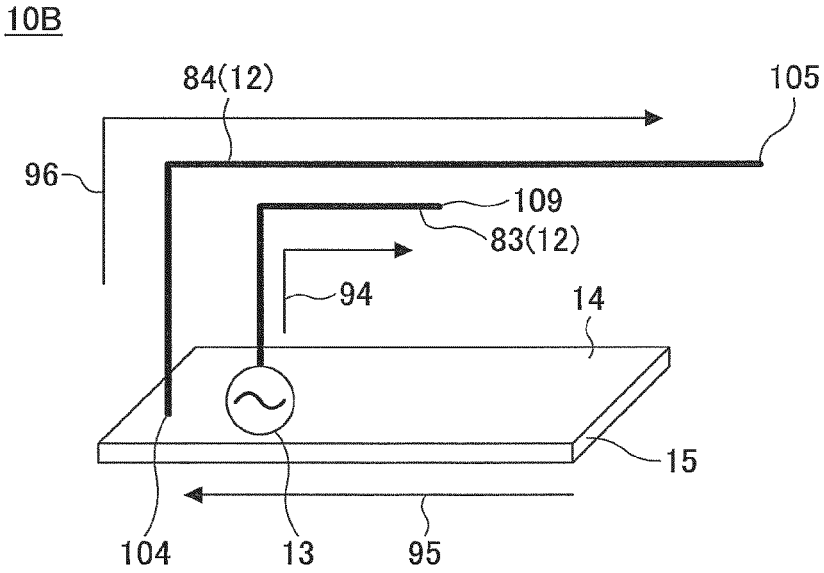
FIG. 13 is a configuration diagram illustrating another modified example of the antenna device according to the first embodiment.

FIG. 13 is a diagram illustrating an example of a configuration of an antenna device 10B for a case where the first element 14, at least a part of which is the wide conductor, is used as the ground conductor. Since the antenna device 10B includes the first element 14, at least the part of which is the wide conductor, the wide-band characteristics of the antenna device 10B can be achieved. At least a part of the edge side of the first element 14, at least the part of which is the wide conductor, is formed along the edge side of the side surface part 22, on which the second element 12 is formed.

The second element 12 includes a feed element 83; and a radiating element 84. The feed element 83 feeds power to the radiating element 84 in a contactless manner. The feed element 83 is, for example, an L-shaped element including one end coupled to the feeding part 13; and an open end 109 at the side opposite to the one end. The feed element 83 is provided with a part that extends parallel to the radiating element 84 while being separated by a distance with which power can be fed to the radiating element 84 in a contactless manner. The radiating element 84 is, for example, an L-shaped element including one edge 104 connected to the first element 14, which is used as the ground conductor; and the other edge 105 at the side opposite to the one edge 104.

The combined electric current vector generated in the antenna device 10B is determined by a first electric current 95 from the end portion 15 of the first element 14 toward the edge 104; a second electric current 94 from the feeding part 13 toward the open end 109; and a third electric current 96 from the edge 104 toward the edge 105.

Figure 14:
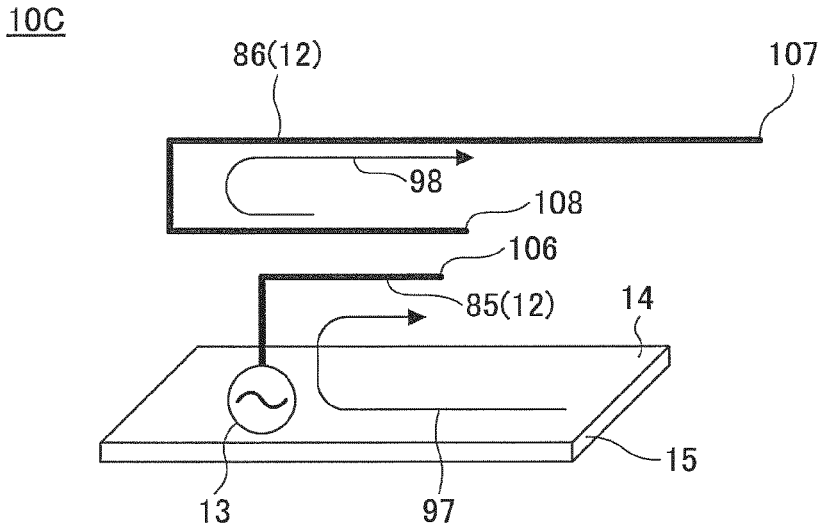
FIG. 14 is a configuration diagram illustrating another modified example of the antenna device according to the first embodiment.

FIG. 14 is a diagram illustrating an example of a configuration of an antenna device 10C for a case where the first element 14, at least a part of which is the wide conductor, is used at the ground conductor. Since the antenna device 10C includes the first element 14, at least the part of which is the wide conductor, the wide-band characteristics of the antenna device 10C can be achieved. At least a part of the edge side of the first element 14, at least the part of which is the wide conductor, is formed along the edge side of the side surface part 22, on which the second element 12 is formed.

The second element 12 includes a feed element 85; and a radiating element 86. The feed element 85 feeds power to the radiating element 86 in a contactless manner. The feed element 85 is, for example, an L-shaped element including one end coupled to the feeding part 13; and an open end 106 at the side opposite to the one end. The feed element 85 is provided with a part that extends parallel to the radiating element 86 while being separated by a distance with which power can be fed to the radiating element 86 in a contactless manner. The radiating element 86 is, for example, a U-shaped element including a first open end 107 that is far from the open end 106; and second open end 108 that is close to the open end 106. The second open end 108 is the edge at the side at which it is electrically coupled to the feed element 85.

The combined electric current vector generated in the antenna device 10C is determined by a first electric current 97 from the end portion 15 of the first element 14 toward the open end 106 of the feed element 85; and a second electric current 98 from the second open end 108 toward the first open end 107.

Furthermore, when, in FIG. 6, the first element 14, at least the part of which is the wide conductor, is used as the ground conductor, and when the feeding part 13 is formed at the short edge of the element 14, the second element 12 preferably has a conductor portion that extends parallel to the short edge of the first element 14; and a conductor portion that extends parallel to the long edge of the first element. By the second element 12 provided with this configuration, wide-band characteristics of the antenna device 10 can be achieved.

Figure 15:
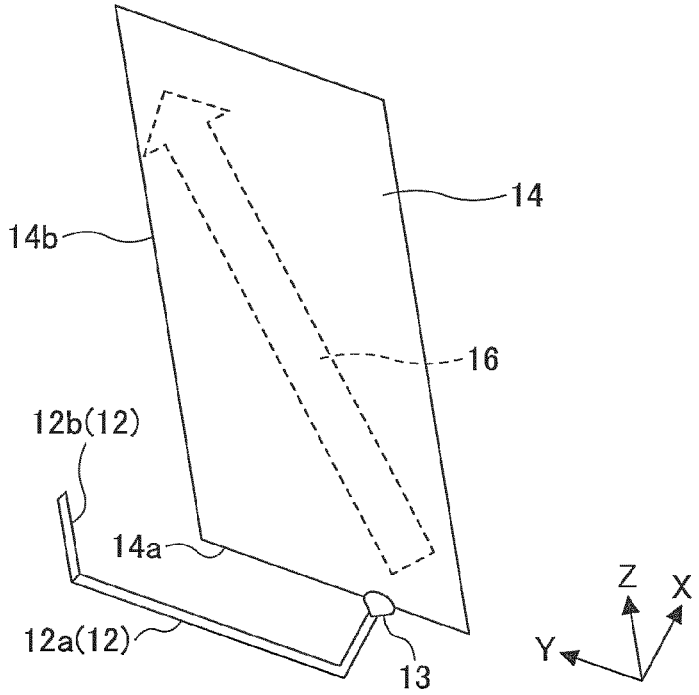
FIG. 15 is a diagram illustrating an embodiment in which a second element is provided with a conductor portion that extends parallel to a short side of a first element.

For example, FIG. 15 is a diagram illustrating an example of a configuration where the second element 12 is provided with a conductor portion 12*a* that extends parallel to a short edge 14*a* of the first element 14; and a conductor portion 12*b* that extends parallel to a long edge 14*b* of the first element 14. The first element 14 is the wide conductor having a rectangular shape including the short edge 14*a* and the long edge 14*b*; and is arranged parallel to the YZ plane. The short edge 14*a* is formed along the edge side of the side surface part 22, on which the second element 12 is formed.

The feeding part 13 is formed on the short edge 14*a*. The conductor portion 12*a* is an L-shaped element whose one end is coupled to the feeding part 13; and is formed parallel to the XY plane. The conductor portion 12*b* is a linear element connected to the other end of the conductor portion 12*a*; and is formed parallel to the ZX plane.

The conductor portion 12*a* is arranged along the short edge 14*a*; and the conductor portion 12*b* is arranged along the long edge 14*b*. Consequently, an electric current that flows in the first element 14, which is the ground conductor, from the feeding part 13 flows to correspond to an electric current that flows in the second element 12, so that it flows along the long edge 14*b* after flowing along the short edge 14*a*. As a result, an electric current path 16 in the diagonal direction of the first element 14, which is the ground conductor, is achieved, so that various electric current path lengths toward the diagonal direction can be obtained, and broad-band characteristics of the antenna device is developed.

Figure 16:
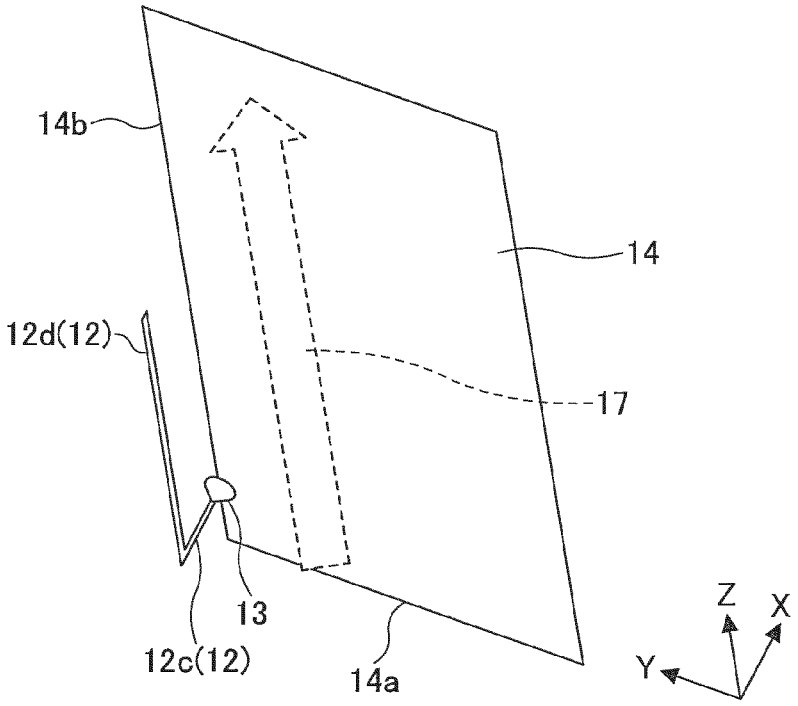
FIG. 16 is a diagram illustrating an embodiment in which the second element is not provided with the conductor portion that extends parallel to the short side of the first element.

In contrast, FIG. 16 is a diagram illustrating an example of a configuration where the second element 12 does not have the conductor portion that extends parallel to the short edge 14*a* of the first element 14. It is the diagram of the example of the configuration where the second element 12 includes a conductor portion 12*c* that is perpendicular to the long edge 14*b*; and a conductor portion 12*d* that extends along the long edge 14*b*. The feeding part 13 is formed on the long edge 14*b*. The conductor portion 12*c* is a linear element whose one end is coupled to the feeding part 13; and is formed parallel to the ZX plane. The conductor portion 12*d* is a linear element connected to the other end of the conductor portion 12*c*; and is formed parallel to the ZX plane.

For a case of FIG. 16, an electric current that flows in the first element 14, which is the ground conductor, from the feeding part 13 flows to correspond to an electric current that flows in the second element 12, so that it flows along the long edge 14*b*. As a result, only electric current paths 17 in the longitudinal direction parallel to the long edge 14*b* of the first element 14, which is the ground conductor, are generated, so that it is difficult to develop the broad-band characteristics of the antenna device.

Second Embodiment

Figure 7:
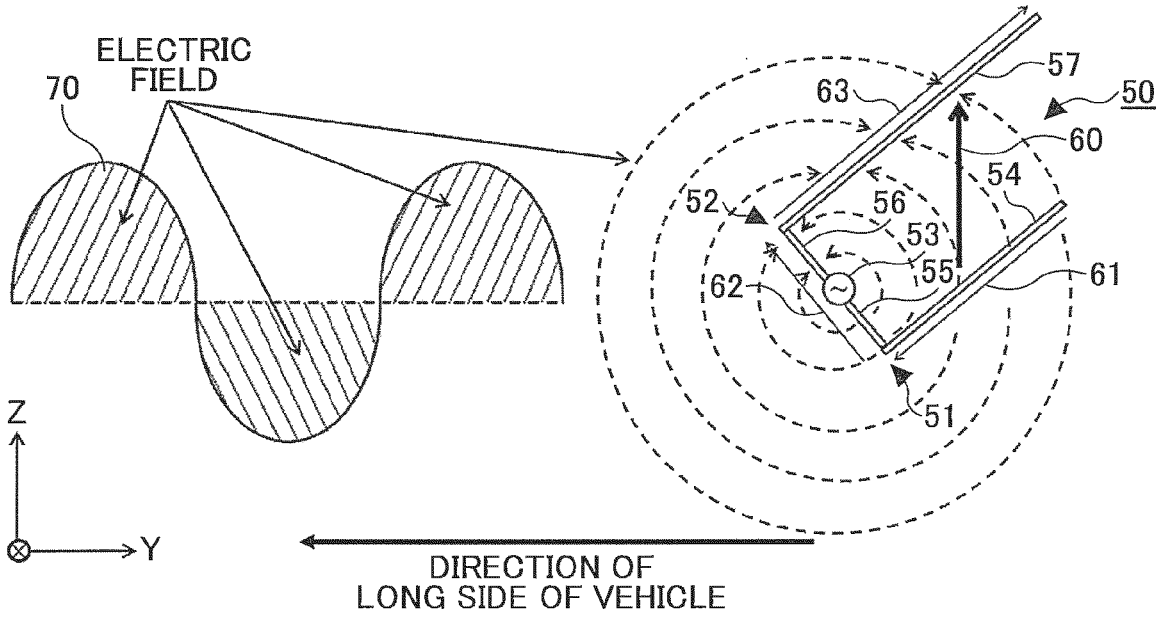
FIG. 7 is a schematic diagram illustrating an antenna device according to a second embodiment of the present invention and a general electric field plane of a vertically polarized wave.

FIG. 7 is a schematic diagram illustrating an antenna device 50 according to a second embodiment of the present invention. The antenna device 50 includes an element 54, whose one end is an open end and the other end is connected to an element 55; a first element 51 formed of the element 55, whose one end is connected to the element 54 and the other end is coupled to a feeding part 53; an element 56, whose one end is coupled to the feeding part 53 and the other end is connected to an element 57; a second element 52 formed of the element 57, whose one end is connected to the element 56 and the other end is an open end; and the feeding part 53. When power of a high frequency electric current is fed to the first element 51 and the second element 52 by the feeding part 53, an electric current flows in the first element 51 and the second element 52. Then, a magnetic field is generated in the vicinity of the first element 51 and the second element 52, and an electric field plane perpendicular to the magnetic field plane is generated.

As illustrated in FIG. 7, the electric field plane generated in the antenna device 50 is formed parallel to the YZ plane of FIG. 7. At this time, if an angle formed between the YZ plane in FIG. 7 and a long side (the Y axis direction) of a vehicle is within a range of ±45 degrees, an angle formed with an electric field plane of a vertically polarized wave 70 arriving at the vehicle in a direction horizontal to the ground (the Y axis direction) is within a range of ±45 degrees, so that transmission and reception characteristics with respect to the vertically polarized wave 70 arriving in the direction horizontal to the ground (the Y axis direction) are enhanced. Preferably, the angle is within a range of ±30 degrees; and, more preferably, the angle is within a range of ±20 degrees.

Figure 8:
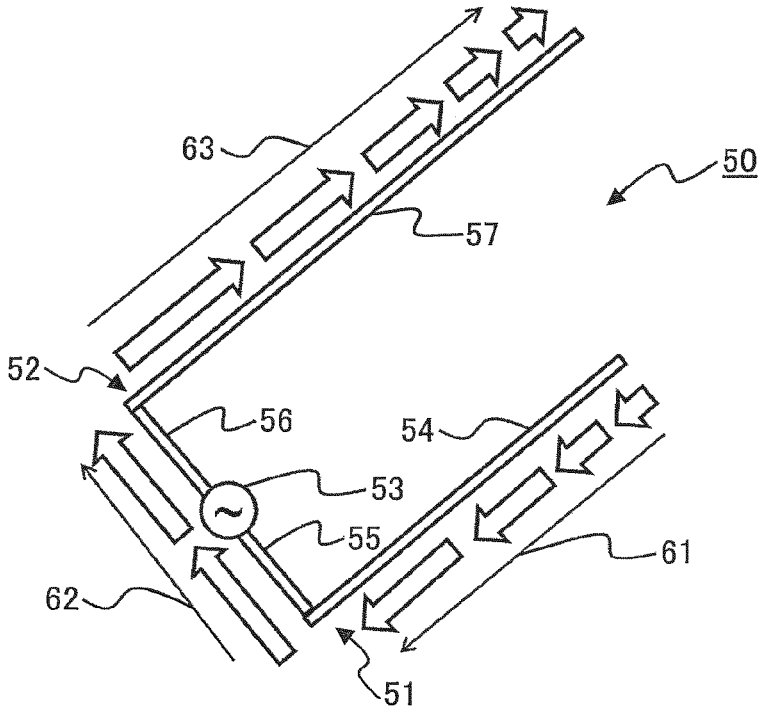
FIG. 8 is a schematic diagram illustrating an electric current vector of the antenna device according to the second embodiment of the present invention.

By using FIG. 8, operation of the antenna device 50 according to the second embodiment of the present invention is described. In the antenna device 50 according to the second embodiment, the element 54, whose one end is the open end and the other end is connected to the element 55, the first element 51 formed of the element 55, whose one end is connected to the element 54 and the other end is coupled to the feeding part 53, the element 56, whose one end is coupled to the feeding part 53 and the other end is connected to the element 57, and the second element 52 formed of the element 57, whose one end is connected to the element 56 and the other end is the open end, are electrically coupled to the feeding part 53, respectively.

The feeding part 53 is a part for coupling the antenna device 50 to a signal processing circuit, which is not depicted. In FIG. 8, the feeding part 53 is located between the element 55 and the element 56; however, it is not limited to this, as long as the antenna device 50 can operate as a dipole antenna with such a part.

As illustrated in FIG. 8, upon power being fed by the feeding part 53 to the antenna device 50, an electric current is generated from the open end of the element 54 to the open end of the element 57. At this time, an electric current distribution becomes stronger from the edge of the element 54 toward the feeding part 53; and the electric current distribution becomes weaker from the feeding part 53 toward the edge of the element 57. Ideally, the electric current approaches zero without limit at the edges of the element 54 and the element 57.

In the element 54, a first electric current vector 61 is generated that is determined by the electric current distribution flowing from the edge of the element 54 to the part connected to the element 55; and an extending direction from the edge of the element 54 to the part connected to the element 55.

In the part formed of the element 55, the feeding part 53, and the element 56, a second electric current vector 62 is generated that is determined by the electric current distribution flowing, to the part at which the element 56 and the element 57 are connected, from the part at which the element 54 and the element 55 are connected; and an extending direction, to the part at which the element 56 and the element 57 are connected, from the part at which the element 54 and the element 55 are connected.

In the element 57, a third electric current vector 63 is generated that is determined by the electric current distribution flowing, to the open end of the element 57, from the part at which the element 56 and the element 57 are connected; and an extending direction, to the open end of the element 57, from the part at which the element 56 and the element 57 are connected.

Figure 9:
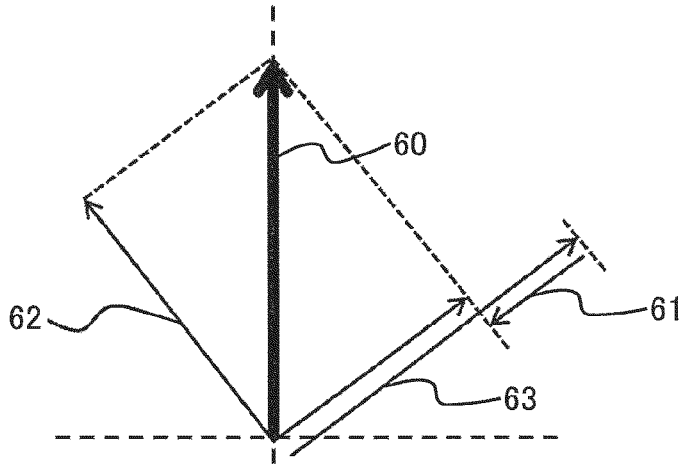
FIG. 9 is a schematic diagram illustrating a combined electric current vector of the antenna device according to the second embodiment of the present invention.

When the element 54 and the element 57 are arranged in parallel, the first electric current vector 61 and the third electric current vector 63 are vectors having opposite directions, as illustrated in FIG. 9. Thus, for a combined electric current vector 60 of the antenna device 50, the combination of the difference between the first electric current vector 61 and the third electric current vector 63 and the second electric vector 62 is the combined electric current vector 60.

As illustrated in FIG. 9, if the direction of the combined electric current vector 60 generated in the antenna device 50 is an angle within a range of 90 degrees±45 degrees with respect to the ground, transmission and reception characteristics with respect to the vertically polarized waves arriving in the direction horizontal to the ground are enhanced. Preferably, the angle is within a range of 90 degrees±30 degrees; and, more preferably, the angle is within a range of 90 degrees±20 degrees.

Note that, in FIG. 8, a case is exemplified where the element 54 and the element 57 are parallel; however, the element 54 and the element 57 may not be parallel, and may include bends and branches, respectively.

As described in the first embodiment and the second embodiment, when the antenna device according to the embodiment is to be attached to a vehicle, it is not necessary to form the first element and the second element on the surface of the window glass of the vehicle, so that the transmission and reception characteristics of the vertically polarized waves arriving in the direction horizontal to the ground do not depend on the installation angle of the window glass of the vehicle, and the transmission and reception characteristics of the vertically polarized waves arriving in the direction horizontal to the ground can be enhanced.

Furthermore, for the antenna device according to the embodiment, as in Patent Document 2, it is not necessary to bend the first element or the second element toward the vehicle interior, so that it can be attached to the vehicle with a simple method.

The preferred embodiments of the present invention are described above; however, the present invention is not limited to the above-described embodiments, and various modifications, improvements, and substitutions can be added to the above-described embodiments without departing from the scope of the present invention.

Examples

Figure 10:
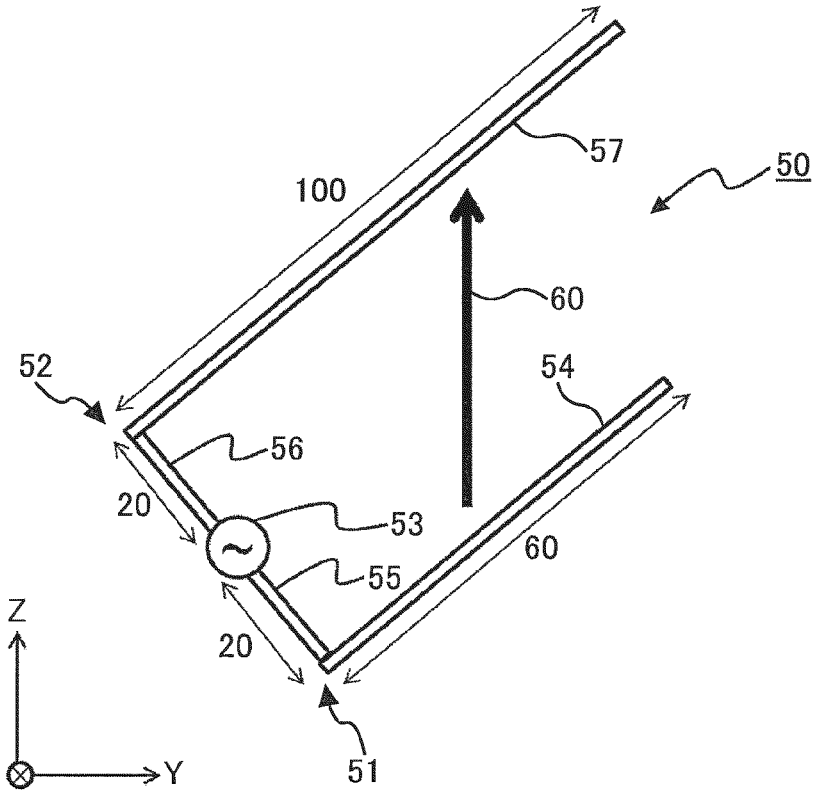
FIG. 10 is a plan view of the antenna device according to the second embodiment.

The sizes of the elements of the antenna device 50 illustrated in FIG. 10 are as follows: the element 54 is 60 mm; the element 55 is 20 mm; the element 56 is 20 mm; and the element 57 is 100 mm.

Figure 11:
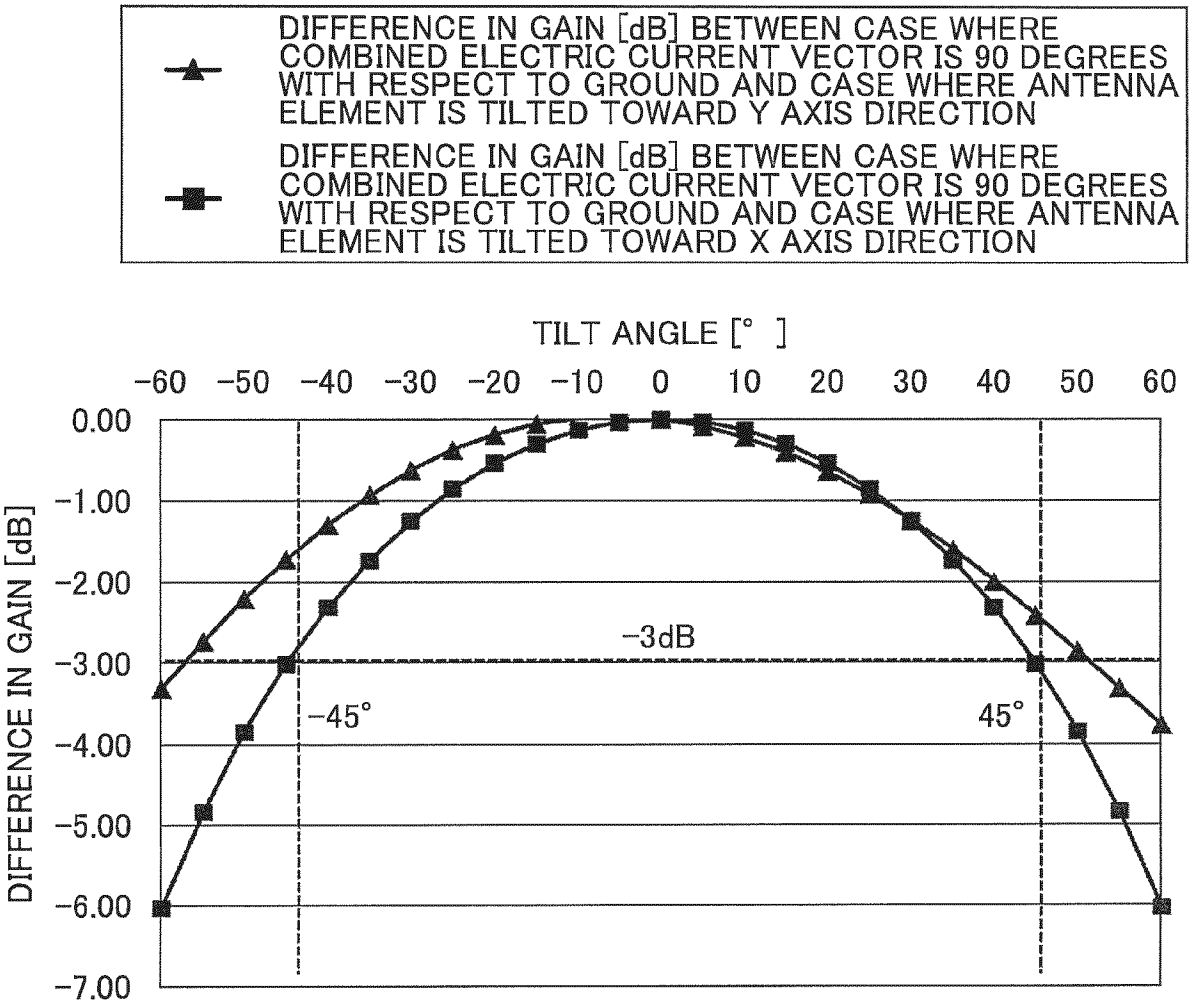
FIG. 11 is a graph showing a calculation result of the relationship between gain and a tilt angle when the antenna device according to the second embodiment is tilted.

FIG. 11 is a calculation result showing the directivity for a case where the combined vector 60 of the antenna device 50 illustrated in FIG. 10 is in the vertical direction (90 degrees) with respect to the ground, namely, in the Z axis direction. Here, for the calculation, Microwave Studio (registered trademark) (CST Corporation) was used as an electromagnetic field simulator.

Table 1 and FIG. 11 show the result of calculating a difference between the gain for a case where the combined current vector 60 of the antenna device 50 illustrated in FIG. 10 is in the vertical direction (90 degrees) with respect to the ground, namely, in the Z axis direction, and the gain for a case where the antenna device 50 is tilted in the +Y axis direction and in the −Y axis direction. Table 1 and FIG. 11 show the result of calculating a difference between the gain for a case where the combined current vector 60 of the antenna device 50 illustrated in FIG. 10 is in the vertical direction (90 degrees) with respect to the ground, namely, in the Z axis direction, and the gain for a case where the antenna device 50 is tilted in the +X axis direction (the depth direction with respect to the paper plane) and in the −X axis direction (the forward direction with respect to the paper plane).

TABLE 1

| | TILT ANGLE OF ANTENNA DEVICE 50 | | | | | |
|---|---|---|---|---|---|---|
| | 10° | 20° | 30° | 40° | 45° | 60° |
| DIFFERENCE IN GAIN [dB] BETWEEN CASE WHERE COMBINED ELECTRIC CURRENT VECTOR IS 90 DEGREES WITH RESPECT TO GROUND AND CASE WHERE ANTENNA ELEMENT IS TILTED TOWARD + Y AXIS DIRECTION | −0.22 | −0.64 | −1.24 | −1.99 | −2.42 | −3.76 |
| DIFFERENCE IN GAIN [dB] BETWEEN CASE WHERE COMBINED ELECTRIC CURRENT VECTOR IS 90 DEGREES WITH RESPECT TO GROUND AND CASE WHERE ANTENNA ELEMENT IS TILTED TOWARD − Y AXIS DIRECTION | 0.02 | −0.19 | −0.62 | −1.30 | −1.72 | −3.31 |
| DIFFERENCE IN GAIN [dB] BETWEEN CASE WHERE COMBINED ELECTRIC CURRENT VECTOR IS 90 DEGREES WITH RESPECT TO GROUND AND CASE WHERE ANTENNA ELEMENT IS TILTED TOWARD + X AXIS DIRECTION | −0.13 | −0.54 | −1.25 | −2.32 | −3.00 | −6.02 |
| DIFFERENCE IN GAIN [dB] BETWEEN CASE WHERE COMBINED ELECTRIC CURRENT VECTOR IS 90 DEGREES WITH RESPECT TO GROUND AND CASE WHERE ANTENNA ELEMENT IS TILTED TOWARD − X AXIS DIRECTION | −0.13 | −0.54 | −1.25 | −2.32 | −3.00 | −6.02 |

As shown in Table 1 and FIG. 11, it can be seen that, when the antenna device 50 is tilted by 45 degrees in the +Y axis direction, the gain is decreased by 2.42 dB with respect to the gain when the direction of the combined electric current vector 60 is 90 degrees. It can be seen that, when the antenna device 50 is tilted by 45 degrees in the −Y axis direction, the gain is decreased by 1.72 dB with respect to the gain when the direction of the combined electric current vector 60 is 90 degrees. Furthermore, it can be seen that, when the antenna device 50 is tilted by 45 degrees in the +X axis direction, the gain is decreased by 3.00 dB with respect to the gain when the direction of the combined electric current vector 60 is 90 degrees. It can be seen that, when the antenna device 50 is tilted by 45 degrees in the −X axis direction, the gain is decreased by 3.00 dB with respect to the gain when the direction of the combined electric current vector 60 is 90 degrees.

Namely, even if the direction of the combined electric current vector 60 generated in the antenna device 50 is tilted with respect to the ground, not only in the +Y axis direction and the −Y axis direction, but also in the +X axis direction and in the −X axis direction, if the tilt angle is less than or equal to 45 degrees, the gain decreases only by 3.00 dB at most.

From the above, it can be seen that if the direction of the combined electric current vector 60 generated in the antenna device 50 is an angle within a range of 90 degrees±45 degrees, favorable transmission and reception characteristics can be obtained with respect to vertically polarized waves arriving in the direction horizontal to the ground.

The invention claimed is:

1. An antenna device installed in a vehicle, the antenna device comprising:

a first element comprising a first conductor;

a second element comprising a second conductor; and a feeding part that electrically couples the first element to the second element, wherein the first element extends in a first direction, the second element extends in a second direction, and the first direction and the second direction are disposed on a plane that forms an angle in a range of 90 degrees±45 degrees with respect to a ground, the feeding part is configured to supply a high frequency electric current to the first element and the second element, thereby generating a first electric current in the first element along the first direction and a second electric current in the second element along the second direction, the first electric current and the second electric current generating an electric field having an electric field plane on the plane on which the first direction and the second direction are disposed, an angle formed between the plane on which the first direction and the second direction are disposed and a direction of a longitudinal axis of the vehicle is within a range of ±45 degrees, and a direction of a combined electric current vector determined by vector addition of a first electric current vector and a second electric current vector extends at the angle in the range of 90 degrees±45 degrees with respect to the ground, the first electric current vector being determined by a direction and a strength of the first electric current generated in the first element, and the second electric current vector being determined by a direction and a strength of the second electric current generated in the second element.

2. The antenna device according to claim 1, wherein each of the first element and the second element has an open end, and wherein the first element and the second element are electrically coupled to the feeding part at respective ends that differ from the open end.

3. The antenna device according to claim 1, wherein the first element, the second element, and the feeding part are formed at a side surface part that is approximately parallel to the direction of the longitudinal axis of the vehicle, the side surface part being included in a support member.

4. The antenna device according to claim 3, wherein the support member is attached to an inner surface of a window glass of the vehicle.

5. The antenna device according to claim 4, wherein the window glass is a windshield or a rear glass of the vehicle.

6. The antenna device according to claim 1, wherein the first element and the second element are configured to transmit and receive radio waves from a 700 MHz band to a 6 GHz band.

7. A vehicle antenna comprising:

the antenna device according to claim 1.

8. A vehicle antenna comprising:

a plurality of antenna devices, each of the antenna devices comprising the antenna device according to claim 1.

9. The antenna device according to claim 1, wherein the first element and the second element are linear.

10. An antenna device installed in a vehicle, the antenna device comprising:

a first element comprising a first conductor;

a second element comprising a second conductor; and a feeding part that electrically couples the first element to the second element, wherein the first element extends in a first direction, the second element extends in a second direction, and the first direction and the second direction are disposed on a plane that forms an angle in a range of 90 degrees±45 degrees with respect to a ground, the feeding part is configured to supply a high frequency electric current to the first element and the second element, thereby generating a first electric current in the first element along the first direction and a second electric current in the second element along the second direction, the first electric current and the second electric current generating an electric field having an electric field plane on the plane on which the first direction and the second direction are disposed, at least a part of the first element is a wide conductor, and at least a part of the wide conductor is formed on a surface adjacent to a side surface part that is approximately parallel to a direction of a longitudinal axis of the vehicle, an angle formed between the plane on which the first direction and the second direction are disposed and the direction of the longitudinal axis of the vehicle is within a range of ±45 degrees, and a direction of a combined electric current vector determined by vector addition of a first electric current vector and a second electric current vector extends at the angle in the a range of 90 degrees±45 degrees with respect to the ground, the first electric current vector being determined by a direction and a strength of the first electric current generated in the first element, and the second electric current vector being determined by a direction and a strength of the second electric current generated in the second element.

11. The antenna device according to claim 10, wherein each of the first element and the second element has an open end, and wherein the first element and the second element are electrically coupled to the feeding part at respective ends that differ from the open end.

12. The antenna device according to claim 10, wherein the first element, the second element, and the feeding part are formed at the side surface part that is approximately parallel to the direction of the longitudinal axis of the vehicle, the side surface part being included in a support member.

13. The antenna device according to claim 10, wherein the wide conductor is a ground conductor.

14. A vehicle comprising an antenna device, the antenna device comprising:

a first element comprising a first conductor;

a second element comprising a second conductor; and a feeding part that electrically couples the first element to the second element, wherein the first element extends in a first direction, the second element extends in a second direction, and the first direction and the second direction are disposed on a plane that forms an angle in a range of 90 degrees±45 degrees with respect to a ground, the feeding part is configured to supply a high frequency electric current to the first element and the second element, thereby generating a first electric current in the first element along the first direction and a second electric current in the second element along the second direction, the first electric current and the second electric current generating an electric field having an electric field plane on the plane on which the first direction and the second direction are located, at least part of the first element is a wide conductor, and at least part of an edge side of the wide conductor is formed on a side surface part that is approximately parallel to a direction of a longitudinal axis of the vehicle, an angle formed between the plane on which the first direction and the second direction are disposed and the direction of the longitudinal axis of the vehicle is within a range of ±45 degrees, and a direction of a combined electric current vector determined by vector addition of a first electric current vector and a second electric current vector extends at the angle in the range of 90 degrees±45 degrees with respect to the ground, the first electric current vector being determined by a direction and a strength of the first electric current generated in the first element, and the second electric current vector being determined by a direction and a strength of the second electric current generated in the second element.

15. The vehicle according to claim 14, wherein each of the first element and the second element has an open end, and wherein the first element and the second element are electrically coupled to the feeding part at respective ends that differ from the open end.

16. The vehicle according to claim 14, wherein the first element, the second element, and the feeding part are formed at the side surface part that is approximately parallel to the direction of the longitudinal axis of the vehicle, the side surface part being included in a support member.

17. The vehicle according to claim 14, wherein the wide conductor is a ground conductor.

* * * * *